US010998180B2

(12) United States Patent
Hinrichs

(10) Patent No.: US 10,998,180 B2
(45) Date of Patent: May 4, 2021

(54) COOLING PLATE FOR ICP-MS

(71) Applicant: Thermo Fisher Scientific (Bremen) GmbH, Bremen (DE)

(72) Inventor: Joachim Hinrichs, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 16/684,143

(22) Filed: Nov. 14, 2019

(65) Prior Publication Data

US 2020/0194247 A1 Jun. 18, 2020

(30) Foreign Application Priority Data

Dec. 12, 2018 (GB) ..... 1820201

(51) Int. Cl.
*H01J 49/10* (2006.01)
*H01J 49/06* (2006.01)

(52) U.S. Cl.
CPC ..... *H01J 49/105* (2013.01); *H01J 49/067* (2013.01)

(58) Field of Classification Search
CPC ..... H01J 49/105; H01J 49/067
See application file for complete search history.

(56) References Cited

U.S. PATENT DOCUMENTS 4,760,253 A * 7/1988 Hutton ..... H01J 49/067 250/281
5,051,584 A * 9/1991 Gray ..... H01J 49/105 250/288
5,148,021 A 9/1992 Okamoto et al.
5,793,039 A * 8/1998 Oishi ..... H01J 49/067 250/288
5,841,531 A * 11/1998 Gliddon ..... G01J 3/443 356/316
6,122,050 A 9/2000 Rutzke
8,242,440 B2 * 8/2012 Splendore ..... H01J 49/0404 250/288
2004/0099811 A1 5/2004 Choi et al.
(Continued)

FOREIGN PATENT DOCUMENTS

CN 102263004 B 1/2014
GB 2314672 A 1/1998
(Continued)

OTHER PUBLICATIONS

Examination report dated Aug. 6, 2020, issued to AU Patent Application No. 2019261698.
(Continued)

*Primary Examiner* — Sean M Luck

(57) ABSTRACT

Disclosed is a plasma sampling interface for an inductively coupled mass spectrometer, comprising a housing having entry and exit openings for respectively introducing and releasing ions from the chamber, and a sampler mounted on the housing so as to be disposed adjacent to plasma generated by an inductively coupled plasma source, wherein the entry opening is provided in a cooling plate that is integral to the housing and that is formed from bronze. Also disclosed is a bronze cooling plate for receiving and cooling a plasma sampler in an inductively coupled mass spectrometer, and a mass spectrometer that comprises a plasma sampling interface as disclosed.

33 Claims, 5 Drawing Sheets

(56) References Cited

U.S. PATENT DOCUMENTS

| | | | | |
|---|---|---|---|---|
| 2004/0185670 | A1 | 9/2004 | Hamelin et al. | |
| 2005/0082471 | A1* | 4/2005 | Kalinitchenko ..... | H01J 49/105<br>250/286 |
| 2005/0194530 | A1 | 9/2005 | Thakur | |
| 2006/0202130 | A1* | 9/2006 | Kollmer ..... | H01J 49/16<br>250/423 R |
| 2011/0186436 | A1* | 8/2011 | Novosselov ..... | G01J 1/58<br>204/600 |
| 2013/0057858 | A1 | 3/2013 | Ardelt et al. | |
| 2017/0210141 | A1* | 7/2017 | Leoni ..... | B41J 2/415 |

FOREIGN PATENT DOCUMENTS

| | | | |
|---|---|---|---|
| GB | 2470294 | A | 11/2010 |
| JP | S5766636 | A | 4/1982 |
| WO | WO-8912313 | A1 | 12/1989 |

OTHER PUBLICATIONS

Combined Search and Examination Report dated Mar. 28, 2019, to GB Application No. 1820201.0.

* cited by examiner

COOLING PLATE FOR ICP-MS

CROSS-REFERENCE TO RELATED APPLICATIONS

This application claims the priority to GB Patent Application No. 1820201.0, filed on Dec. 12, 2018, which application is hereby incorporated herein by references in its entirety.

FIELD OF THE INVENTION

The invention relates to an interface for an inductively coupled plasma mass spectrometer (ICP-MS). The invention further relates to a cooling plate for use in inductively coupled plasma mass spectrometers.

BACKGROUND OF THE INVENTION

Inductively coupled plasma mass spectrometry (ICP-MS) is an analytical method that is capable of detecting metals and certain non-metals at very low concentration, as low as one part in $10^{15}$ (part per quadrillion, ppq) on non-interfered low-background isotopes. The method involves ionizing the sample to be analysed with an inductively coupled plasma and then using a mass spectrometer to separate and quantify the thus generated ions.

The sample is typically a liquid solution or suspension, supplied in the form of an aerosol in a carrier gas, usually argon. The plasma is generated by ionizing the aerosol in carrier gas in an electromagnetic coil, to generate a highly energized mixture of argon atoms, free electrons and argon ions.

The plasma is generated in a plasma torch, which typically comprises a number of concentric tubes that form respective channels and is surrounded towards its downstream end by a helical induction coil. Plasma gas, typically argon, flows in an outer channel of the torch, and an electric charge is applied to the gas to ionize a portion of the gas. A radio frequency is applied to the torch coil, and the resulting alternating magnetic field causes free electrons to be accelerated, bringing about further ionization of the gas. Thereby, a plasma state is achieved with temperature in the plasma typically in the range of 5,000 to 10,000 K. The sample in carrier gas flows through a central channel of the torch and passes into the plasma, where the extremely high temperature causes atomization and ionization of the sample.

To form an ion beam from the sample ions in the plasma, the plasma is sampled through an aperture in a sampling interface operating under vacuum. This is done by providing a sampler in the form of a sampler cone (or sampling cone) that has a narrow aperture tip, usually about 0.5 to 1.5 mm in diameter. Downstream of the sampler cone, the plasma expands within the sampling interface as it passes through an evacuated expansion chamber within the interface. A central portion of the expanding plasma passes through a second aperture provided by a skimmer cone into a second evacuation chamber that has a higher degree of vacuum. Downstream of the skimmer cone, there are electrostatic lenses that extract ions from the plasma, thereby forming an ion beam. The resulting ion beam is then deflected and/or guided towards a mass spectrometer by one or more ion deflectors, ion lenses and/or ion guides. Sometimes, the ion beam will pass through a collision or reaction cell, for removing potentially interfering ions, before passing through the mass spectrometer.

The plasma is formed in the ICP source at atmospheric pressure. The sampling interface operates at reduced pressure, typically a few mbar. The flow of plasma into the interface is thereby driven by the pressure difference between the plasma and the expansion chamber within the interface.

The sampling interface is sensitive to deposits forming on the sampler cone, resulting in optical defects, noise or other artefacts in the obtained mass spectrum. Deposits can form on the sampler cone, in particular close to its tip, resulting in these artefacts, Clogging can originate in the sample itself, or it can originate in components of the sampling interface.

Conditions at the sample interface in ICP-MS are harsh. Due to the extremely high temperature at the plasma source (up to 10,000 K), the sampler cone needs to be cooled. This is typically achieved by mounting the sampler cone on a water-cooled plate (cooling plate) on the front end of the sampling interface, facing the ICP source. The sampler cone is typically formed from metals that are corrosion-resistant, have a high thermal conductivity and a high melting point. Typical metals used in the sampler cone are nickel and platinum.

The cooling plate is typically formed from copper, which has a very high thermal conductivity. To provide resistance against corrosion from the plasma, the cooling plate is usually plated with a corrosion-resistant plating, such as Ni.

The inventors have however found that the nickel plating on the cooling plate is susceptible to corrosion by aggressive chemicals. With time, corrosion of the coating is followed by blistering in the coating, which finally requires exchange of the cooling plate. However, degradation of the nickel plating can result in optical defects, particle deposition at the sampler cone and/or contamination by nickel isotopes in the analytical signal. A related problem stems from matrix deposition onto the sampler cone that causes signal drift during analysis of high matrix samples.

It would therefore be desirable to provide a sampling interface for ICP-MS that minimizes effects from corrosion or other degradation of the cooling plate.

SUMMARY OF THE INVENTION

The present invention addresses the above described deficiencies by providing an improved interface for inductively coupled plasma mass spectrometers (ICP-MS). The invention furthermore provides an improved cooling plate for use in sampling interfaces that is stable to chemical degradation due to the extreme environment provided by high temperature plasma from the ICP source.

Thus in an aspect, the invention provides a plasma sampling interface for an inductively coupled plasma mass spectrometer (ICP-MS), the interface comprising (i) a housing comprising at least one entry opening for introducing ions from plasma generated by an inductively coupled plasma source into an internal chamber of the housing and at least one exit opening for releasing ions from the chamber, and (ii) a sampler having a sampling aperture, the sampler being mounted on the housing, wherein the sampler, when in use, is disposed adjacent to plasma generated by an inductively coupled plasma source so as to sample ions from the plasma and release sampled ions through the entry opening into the chamber, wherein the entry opening is provided in a cooling plate that is integral to said housing, the sampler being mounted on the cooling plate so as to at least partially cover the entry opening, and wherein the cooling plate is formed from bronze.

Another aspect of the invention relates to a cooling plate, for receiving and cooling a plasma sampler in an Inductively Coupled Mass Spectrometer (ICP-MS), the cooling plate comprising at least one internal channel for transmission of a coolant through the plate, an opening that extends axially through the cooling plate and a sampler seating portion that surrounds said opening, for receiving and securing a sampler to the cooling plate, the cooling plate being characterized in that the cooling plate is comprised of bronze.

Also disclosed is a method of mass spectrometry using a cooling plate as disclosed herein. Thus, a further aspect relates to a method operating a mass spectrometer sampling interface, the method comprising (i) generating plasma by means of an inductively coupled plasma (ICP) source, and (ii) sampling the plasma by means of a sampler that is disposed adjacent to the plasma, wherein the sampler is mounted on an external surface of a cooling plate that is integral to the housing of a sampling interface, wherein the cooling plate is adapted to allow sampled ions to pass through an opening in the cooling plate and into a chamber within the interface, and wherein the cooling plate is formed from bronze. The cooling plate to be used in the method can preferably be a cooling plate as disclosed herein.

Further disclosed herein is a mass spectrometer that comprises a cooling plate as disclosed herein. Also disclosed is a mass spectrometer comprising a plasma sampling interface as described herein. Such a mass spectrometer can in particular be an Inductively Coupled Plasma Mass Spectrometer (ICP-MS).

The following description relates to exemplary embodiments of the invention. It should be appreciated that descriptions of embodiments of the cooling plate are equally applicable to the cooling plate itself, an interface comprising such a cooling plate, a mass spectrometer comprising such a cooling plate or interface, and methods of operating a mass spectrometry interface comprising such a cooling plate.

The purpose of the plasma interface of an ICP-MS is to transmit ions that are generated in the plasma torch in an efficient and consistent manner towards a downstream mass analyser. The plasma is generated at atmospheric pressure (about 1 atm), whereas a mass analyser typically operates at very high vacuum, as low as $10^{-10}$ bar. The sample interface is typically operated at in internal pressure of about $10^{-3}$ bar, with a downstream ion guide usually operating at a pressure of $10^{-5}$ to $10^{-6}$ bar. The pressure difference between the ICP source and the interface, and between the interface and downstream components of the mass spec instrument results in great acceleration of ions as they enter and pass through the plasma interface. The result is a supersonic jet of ions that enters the interface via the sampler (e.g., sampler cone) and exits the interface through a skimmer or skimmer cone.

The sampler can be provided as a conical structure having an aperture, i.e. as a sampler cone that is usually made from metals that have a high thermal conductivity and high melting point, such as Ni plated on Cu, Al, or Pt. To prevent melting of the cones, due to their exposure to the extreme heat of the plasma, they are usually mounted on a plate that is water-cooled, thereby providing a cooling reservoir that cools the sampler and prevents melting of the sampler. Prior art cooling plates are usually made from copper, which has a very high thermal conductivity and is therefore suitable for this purpose. To minimize corrosion effects, such cooling plates usually have an inert coating, typically from Ni. However, with time, even this coating is subject to degeneration and rusting by the harsh conditions of the plasma.

The present invention provides a cooling plate that is made from bronze. By providing the cooling plate in bronze, two important chemical properties that are required of such plates are combined: thermal conductivity and chemical resistance. Thus, while the thermal conductivity of bronze is lower than that of copper, it has been found that bronze provides sufficient thermal conductivity for the requisite cooling of the sampler. Furthermore, bronze is significantly more stable under the harsh conditions of the plasma interface region, as manifested by results showing that a cooling plate made from bronze is stable over an extended time when used in ICP-MS analysis (see Example 1).

Bronze is an alloy consisting primarily of copper, commonly containing tin as a primary second component. In the present context, bronze thus represents a metal alloy that contains copper as a primary component, with tin being the main second component. Bronze can further contain other metals such as arsenic, aluminium, manganese, silicon, nickel or zinc. The incorporation of metals other than copper in the alloy affects the physiochemical properties of the resulting bronze alloy, affecting properties such as thermal and/or electrical conductivity, stiffness, ductility, melting point and machinability of the alloy.

The bronze in accordance with the invention can in general consist of about 70% to about 95% copper, about 75% to about 95%, about 80% to about 95%, or about 85% to about 90% by weight of the bronze material. The remaining balance of composition of the bronze can consist of tin, optionally in combination with one or more additional metals. Thus, the balance of the bronze can comprise 60% or more of tin, such as 70% or more, 75% or more, 80% or more, 85% or more, or 90% or more of tin.

The remaining composition of the bronze material can comprise arsenic, aluminium, manganese, silicon, nickel or zinc, or any combination of two or more of these metals.

The bronze cooling plate can for example comprise about 95% copper and about 5% tin, about 94% copper and about 6% tin, about 93% copper and about 7% tin, about 92% copper and about 8% tin, about 91% copper and about 9% tin, about 90% copper and about 10% tin, about 89% copper and about 11% tin, about 88% copper and about 12% tin, about 87% copper and about 13% tin, about 86% copper and about 14% tin, about 85% copper and about 15% tin, about 84% copper and about 16% tin, about 83% copper and about 17% tin, about 82% copper and about 18% tin, about 81% copper and about 19% tin, or about 80% copper and about 20% tin.

An exemplary embodiment comprises bronze containing about 88% copper and about 12% tin by weight of the bronze. Another exemplary embodiment comprises about 90% copper and about 10% tin by weight of the bronze. Another exemplary embodiment comprises about 86% copper and about 14% tin by weight of the bronze.

Pure copper has a thermal conductivity that is approximately 400 W/mK at room temperature. Bronze has lower thermal conductivity than pure copper, and its chemical composition is reflected in its thermal conductivity. Accordingly, the bronze in accordance with the invention can have a thermal conductivity that is in the range of about 15 to 200 W/mK, in the range of about 20 to 150 W/mK, in the range of about 20 to 100 W/mK, in the range of about 20 to 80 W/mK, in the range of about 20 to 60 W/mK, or in the range of about 20 to 50 W/mK. The thermal conductivity thus defined can be thermal conductivity at or around room temperature, such as in the range of 20° C.-25° C., including at or around 20° C. or at or around 25° C.

As a consequence of the use of bronze as the sole material in the cooling plate, the resulting ICP-MS system is more stable, in that it can be operated over a long time with minimal or no risk of corrosion artefacts, and also in that due to the higher operating temperature of the sampler cone, there will be less risk of matrix deposits at the sampler cone, which again results in less artefacts and more stable operation of the mass spectrometer.

Thus, the physiochemical properties of bronze are quite different from that of copper, including thermal conductivity and ductility. Further, the addition of tin to copper results in an alloy that is more wear- and corrosion resistant than pure copper. Bronze is harder and more corrosive resistant than brass, a copper alloy that contains copper and zinc as main components.

The cooling plate serves the role of a cooling reservoir. During operation, the sampler faces intense heat from the plasma gas, and this heat is dissipated through the sampler and into the cooling reservoir provided by the plate. The cooling plate therefore provides a very important structural role, i.e. for mounting of the sampler, but more importantly a physiochemical role due to its role as a thermal sink that maintains the sampler at a relatively low temperature during operation.

Copper has been found to be a suitable material for the cooling plate, due to its very high thermal conductivity. A drawback of such commonly used cooling plates is the relatively low corrosion resistance of copper, which has been offset by coating the cooling plate with a corrosion resistant layer, usually from nickel.

Increased resistance to corrosion of a bronze cooling plate as compared with currently used nickel-coated copper plates represents one major advantage of the invention. As a result of the corrosion resistance, the cooling plate does not need to be coated with a corrosion-resistant coating. Thus, the cooling plate in accordance with the invention preferably does not contain a coating.

An added advantage of the use of bronze in the cooling plate is that bronze has a lower thermal conductivity than copper. As a result, the operating temperature at the tip of the sampler cone is expected to be higher when using the bronze cooling plate as compared with prior art copper plates. A higher operating temperature, which is still low enough so that the sampler is not damaged by the hot plasma, is expected to result in less interference from potentially interfering components in the sample being analysed. This is especially important for certain high-matrix samples, where it is known that matrix components can lead to matrix redeposits onto the sampler cone which in turn can lead to signal artefacts such as drifts and poorer stability during analysis of such samples.

The sampler is mounted on the cooling plate, over an entry opening in the plate, so that ions from plasma that enter the sampling interface do so through an opening in the sampler. Typically, this interface is provided by an orifice at the tip of a conical structure, the sampler cone. Thus, during use the sampler, and by extension the cooling plate on which the sampler is mounted, face the ICP source.

The ICP source is typically placed very close to the sampler, or at a distance of about 1 cm. As a consequence, the conditions at the sampler and the cooling plate on which the sampler is mounted are quite extreme, in part due to the high temperature of the plasma (5000-10,000 K) and in part due to sample and/or matrix chemical components that are generated by the plasma and that can be corrosive.

The sampler can typically be in the form of a circular structure, for example a circular structure having a cone at its center, having a small diameter orifice at the tip of the cone, the orifice thereby defining a sampling orifice through which ions from plasma enter the sampling interface. The sampler can be mounted on the cooling plate, so that the cooling plate surrounds at least an outer portion of the sampler. Thus, the sampler can be mounted in a recession on the cooling plate that is complementary in shape to the sampler, e.g. in the form of a recession or lip that surrounds the opening (entry opening) in the plate.

The sampler can comprise a flange that extends radially away from the conical structure. The flange can be adapted to meet an outer surface of the cooling plate that surrounds the entry opening. There can be a securing mechanism provided to secure the sampler to the cooling plate via the flange.

A common problem in ICP-MS is blocking or corrosion of the interface cones (sampler and skimmer cones), which may originate in deterioration of the cones themselves, in matrix components originating from the sample, or in corrosion or deterioration of the interface itself, in particular the cooling plate.

The lower thermal conductivity of bronze, compared with copper, is believed to provide an advantage for certain analyses. The somewhat reduced thermal conductivity of a bronze cooling plate, as compared with prior art copper plates, is believed, due to less dissipation of heat from the sampler, to result in a higher working temperature of the sampler, in particular at the sampler cone orifice, when provided as a conical structure. For high-matrix applications, i.e. applications where there is a risk of potentially interfering ions originating in particular from a sample matrix, this is believed to lead to an improved analytical performance, as there is less risk of salt deposition in or around the orifice in the sampler cone at higher operating temperatures of the sampler cone.

The sampler can be secured to the cooling plate by any suitable means. It has found to be beneficial to place a seal, such as a graphite seal, between the sampler and the cooling plate, to provide an airtight connection to the plate. This is done to ensure that ions from the plasma gas can only enter the sampling interface through the sampler orifice.

In an embodiment, the sampler is fastened directly to the cooling plate. This can be achieved for example by providing a thread on the sampler, such as on the outer periphery of the circular sampler structure (i.e. along its outer circumference) or alternatively on an outer periphery of a circular flange portion of the sampler, so that the sampler can be secured to the cooling plate via a complementary thread on the circular entry opening on the plate.

As an alternative, there can be a threaded securing member attached to the cooling plate. The purpose of such a securing member is to provide fastening means for the sampler, i.e. to provide means for securing a sampler to the cooling plate. Such a securing member can comprise a circular structure that is threaded on its inside circumference, wherein the circular threaded opening so provided when the securing member is attached to the cooling plate is complementary to the sampler. The securing member can for example be adapted to meet an outer circular portion of the sampler so that when attached to the plate, the securing member provides means to secure the sampler to the plate. Accordingly, the sampler can be secured to the cooling plate via the securing member.

The securing member thus provided can be alternatively shaped, in particular it can have different outer dimensions, as long as it contains a threaded opening that is complementary to a corresponding threaded portion along the periphery of the sampler, so that the sampler can be attached to the securing member.

As an alternative, the sampler can be secured to the plate, or to a securing member that is fastened to the plate, via a securing flange that attaches to the cooling plate and simultaneously secures the sampler to the cooling plate. The securing flange can be provided so as to meet the outer periphery of the sampler, i.e. an outer portion of the circular sampler. In one such embodiment, the flange is provided as a circular ring structure that is threaded along its outer periphery. The securing flange thus provided can be complementary to a corresponding thread on the cooling plate itself, or complementary to a securing member that is attached to the plate. As the flange is screwed onto the cooling plate or securing member, it will exert a force that is radial to the plate, i.e. a force that is approximately perpendicular to the face of the plate, and thereby force the sampler onto the plate.

The cooling plate can be adapted to have a recess that extends around the entry opening in the cooling plate so that the sampler can be seated within the thus provided circular recess in the plate. There can be a seal placed between the sampler and the plate, so that when the sampler is secured to the plate, the resulting connection is airtight.

Accordingly, in an embodiment, the interface in accordance with the invention comprises a securing flange, for securing the sampler to the cooling plate and providing an airtight seal therebetween, the securing flange comprising an external thread that is adapted to meet a complimentary thread on the plate, so as to secure the securing flange to the cooling plate and thereby exerting force onto the sampler so as to provide a seal between the sampler and the plate.

The interface can further comprise a securing member, the securing member being adapted for mounting onto the external surface of the cooling plate and thereby encircling the entry opening of the plate, the securing member further being threaded on an inner circular surface thereof, so as to provide a complimentary thread for securing the sampler to the cooling plate via the securing flange.

The interface housing can comprise a skimmer or skimmer cone, through which ions exit from the interface. The skimmer can be mounted on an inner surface of the housing, opposite to the sampler, and have an aperture for receiving ions generated by the plasma and releasing those through the aperture. The skimmer preferably covers the exit opening of the interface housing, so that ions can only exit the interface via the orifice in the skimmer cone.

The interface is pumped by a vacuum pump to a pressure of approximately 1 mbar. The downstream components of the mass spec instrument (including at least an ion guide) typically operate at a pressure of about $10^{-5}$ bar. Due to the high-pressure difference between the ICP source (ambient pressure, approx. 1 bar), the interface and the downstream components, there is rapid expansion of plasma gas (plasma components within the interface). The pressure difference and the small orifices at the sampler and skimmer cones result in the formation of a supersonic stream of ions that exit the interface and are guided into the downstream mass analyser by ion guides and other intermediate components of the instrument.

The cooling plate can be cooled so as to provide a thermal sink at constant temperature that can serve the role of maintaining the sampler at a constant and relatively low temperature. The cooling plate can be cooled by a cooling fluid that is transmitted through internal channels in the plate. Such channels can be machined into the plate, or formed by other means known in the art. For example, the channels can be provided as a plurality of straight channels that are machined into the plate. When such channels are formed by drilling a plurality of straight interconnected channels into the plate, there can be provided a stopper at the end of each such channel, near the periphery of the plate, with the exception of an entry opening for delivering cooling fluid into the cooling plate and an exit opening for releasing fluid from the plate. Thereby, circulation of fluid within the cooling plate can be provided.

There can thus be at least one channel provided, having an entry opening to allow cooling fluid (such as water) to enter the channel, and an exit opening for releasing fluid from the channel. There can be a single channel provided for this purpose. There can also be a plurality of interconnected channels within the plate, so as allow for circulation of fluid within the plate. A channel entry opening and a channel exit opening can be provided anywhere on the outside portion of the cooling plate to provide for circulation through the cooling plate (i.e. away from the interface). It can however be preferable to provide such an entry opening and exit opening in such a way that there is a minimal risk of interference during analysis and/or a minimal risk of corrosion or other damage from the plasma gas. Therefore, it can be preferable to place such an entry opening and exit opening on the periphery of the cooling plate, that is, on an outer peripheral edge, for example on a side that faces away from the ICP source.

The above features along with additional details of the invention, are described further in the examples below, which are intended to further illustrate the invention but are not intended to limit its scope in any way.

BRIEF DESCRIPTION OF THE DRAWINGS

The skilled person will understand that the drawings, described below, are for illustration purposes only. The drawings are not intended to limit the scope of the present teachings in any way.

DESCRIPTION OF VARIOUS EMBODIMENTS

In the following, exemplary embodiments of the invention will be described, referring to the figures. These examples are provided to provide further understanding of the invention, without limiting its scope.

In the following description, a series of steps is described. The skilled person will appreciate that unless required by the context, the order of steps is not critical for the resulting configuration and its effect. Further, it will be apparent to the skilled person that irrespective of the order of steps, a time delay may be present between some or all of the described steps.

Figure 1:
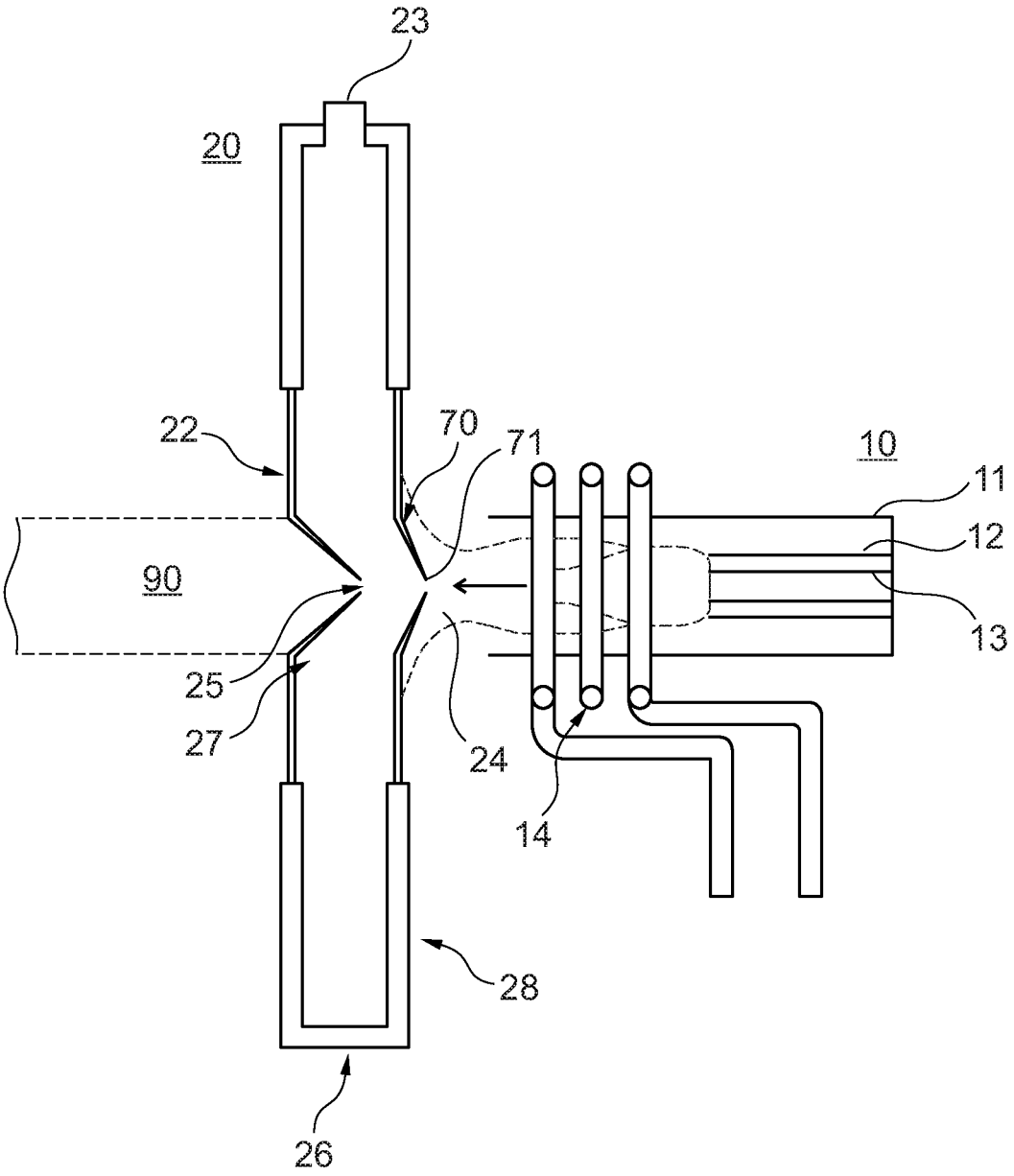
FIG. 1 shows an interface region of an ICP-MS instrument.

In FIG. 1, a plasma interface is shown. Plasma torch 10 consists of three concentrical tubes 11, 12, 13, usually made from quartz. Plasma gas is passed between the outer and middle tubes 11, 12, with an auxiliary gas being supplied between the middle tube 12 and sample tube 13. A sample is provided in a sample gas through the innermost sample tube 13.

The plasma torch is placed centrally in an RF coil 14, about 1-2 cm from the interface 20. A radio frequency (RF) generator provides RF power (typically 750-1500 W) to the coil. The RF oscillations cause an intense electromagnetic field to be generated at the top (end) of the torch. As argon gas flows through the torch, a high-voltage spark is applied to the gas, which causes stripping of electrons from argon atoms. These released electrons collide with other argon atoms in the plasma gas, stripping the argon atoms of more electrons. The result is a chain reaction of events that breaks down the argon atoms into argon ions and electrons. This inductive process is maintained by the continuing transfer of RF energy to the torch.

Sample gas delivered through the innermost tube 13 is delivered into the plasma 24 which has a temperature in the range of 5000-10,000K. The result is a series of chemical changes, starting with desolvation of the sample (typically provided as an aerosol), followed by gas formation and formation of charged ions through the collision of high-energy electrons and argon ions with ground-state atomic species. The arrow indicates flow of plasma gas that is generated in the ICP source towards the plasma interface 20.

The interface consists of a housing 26 that has an internal chamber 27 that is pumped by a vacuum pump via connection 23. Ions from the plasma enter the chamber via a sampler 70, which is typically a conical structure having a small aperture or orifice 71 with an internal diameter that is typically in the range of 0.8-1.2 mm. Within the chamber, the sampled ions from the plasma pass through a second conical structure called a skimmer 22, having an aperture or orifice 25 with a diameter that is typically about 0.4-0.8 mm.

The sampler is mounted on a cooling plate that is integral to the housing 26 so as to provide at least a portion of the external surface of the housing 26 that faces the plasma torch 10. The cooling plate can comprise the entire side 28 of the housing 26 that faces the plasma torch 10, or it can comprise a portion thereof.

Downstream of the interface, there is an ion guide 90 that extracts ions that are passed through the interface. The extracted ions are subsequently guided towards a mass analyser (not shown), where the mass to charge ratio of the ions is determined.

The portion of the interface that faces the ICP torch is in close proximity to the ICP source (10-20 mm from the outer coil 11). This means that the sampler 70 and the portion of the housing on which the sampler is mounted, including the cooling plate, is subjected to the very harsh conditions in the plasma (high temperature and high-energy species within the plasma gas).

Figure 2:
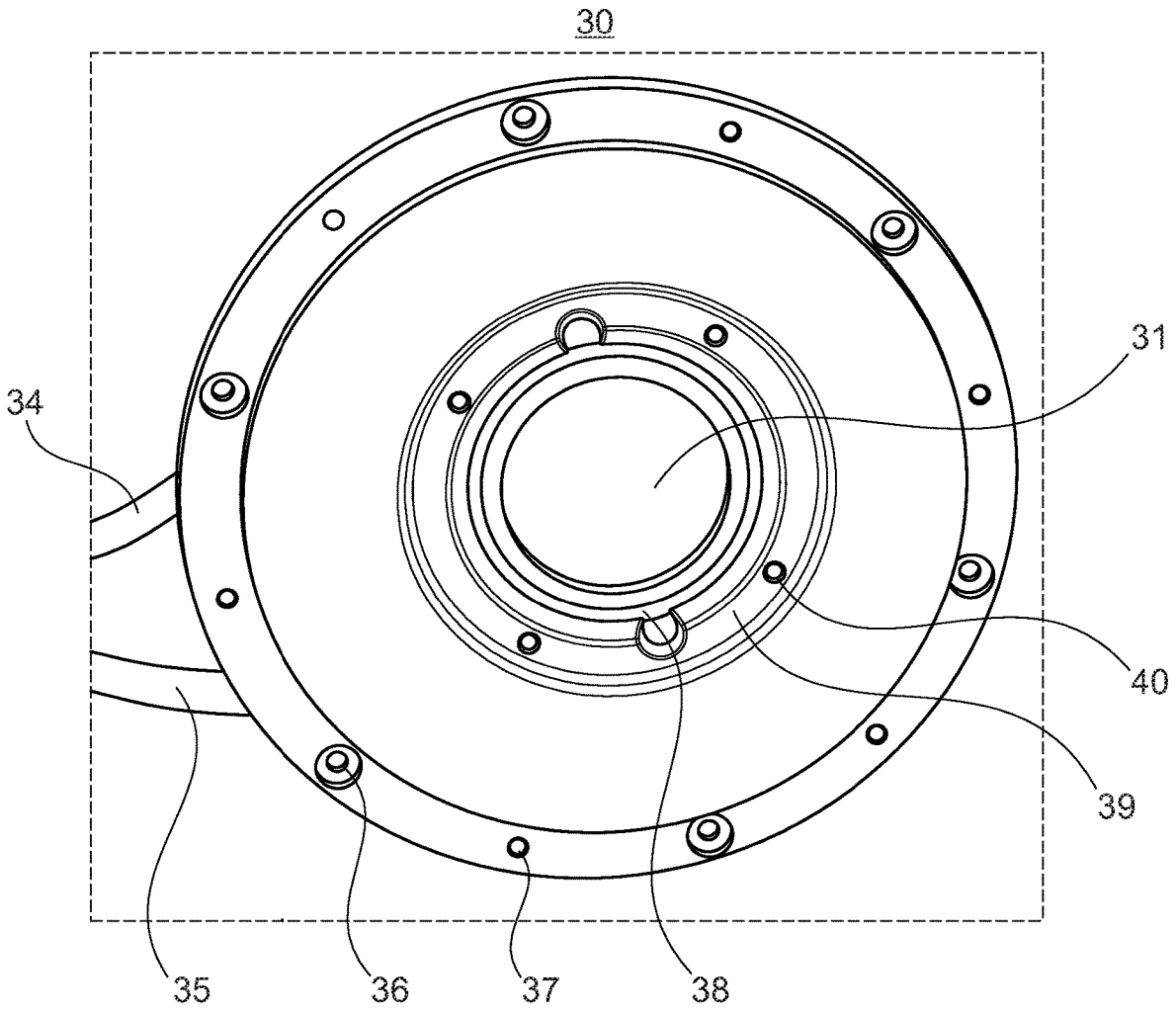
FIG. 2 shows a cooling plate in accordance with the invention.

Turning to FIG. 2, there is shown a cooling plate 30, that can be mounted onto an interface 20 so as to provide a front end thereof (i.e., the end that faces the plasma torch 10). The cooling plate has an entry opening 31 that allows ions to be transmitted into the internal chamber of the plasma interface 20. The cooling plate can be fastened to the plasma interface by using fastening means such as screws, using threaded screw openings 36. Coolant inlet tube 34 and coolant outlet tube 35 provide means to deliver coolant fluid into internal channels within the cooling plate (not shown), so as to keep the main portion of the cooling plate at a relatively constant temperature. There will however typically be a temperature gradient within the plate, with the centre of the cooling plate directed towards the sampler (sampler cone) being hottest. The cooling fluid is typically provided at a temperature of about 20° C. As a consequence, the lower end of the temperature range of the plate, at the outer peripheral edge of the plate, will approximate the temperature of the cooling fluid. At its centre, where the cooling plate meets the sampler, the temperature of the cooling plate will however be much higher, or as high as a few hundred degrees Celsius. It should therefore be appreciated that the thermal conductivity of the plate will be very important for its function.

The cooling plate entry opening is circular. Flanking the opening is a first seating portion 38, on which a sampler (not shown) can be placed. A second seating portion 39 is shown, outwardly and radially from the first seating portion 38. This second seating portion 39 is provided to accommodate a securing member (not shown), that is secured to the cooling plate for allowing the sampler to be secured to the cooling plate in an airtight fashion. The securing member, having a circular ring shape, is attached to the cooling plate 30 using screws that are inserted into threaded holes 40 on the second seating portion 39.

A graphite seal (not shown) is preferably placed under the sampler so as to provide an airtight seal between the sampler and the cooling plate. The circular seal is disposed on the first seating portion 38, between the cooling plate 30 and the sampler. The securing member provides means to secure the sampler to the plate, via a securing flange that screws onto the securing member and thereby exerts force onto the sampler and the graphite seal sitting between the sampler and the cooling plate, so as to secure the sampler to the cooling plate and provide an airtight seal between the sampler and the plate. Thereby, ions from plasma can only enter the sampling interface via the orifice 71 on the conical tip on the sampler.

Figure 3:
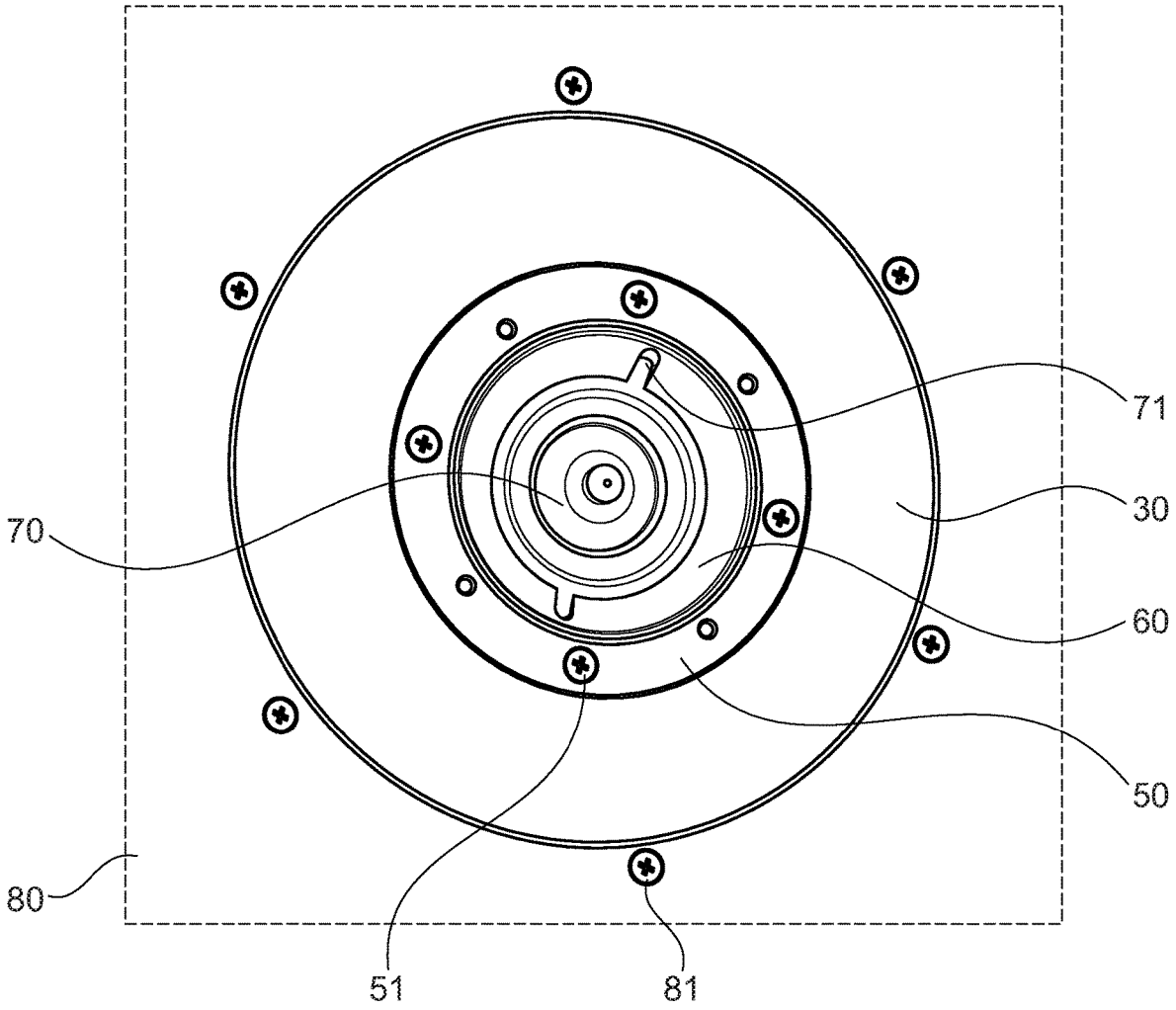
FIG. 3 shows a front view of an interface comprising a cooling plate in accordance with the invention.

In FIG. 3 there is shown a front view of the front end of a plasma sampling interface that faces the adjacent ICP source. A sampler 70 having a general conical structure is mounted on a cooling plate 30 so as to cover the entry opening of the cooling plate. The sampler is held in place by securing flange 60. The circular securing flange is threaded on its outer periphery so that the flange can be screwed into a complementary thread on securing member 50 that is secured to the cooling plate via screws 51. Notches 71 are provided in the securing flange, providing means for screwing the securing flange 60 into the securing member 50 using a tool (not shown) that is adapted to fit into the notches 71. As the securing flange is screwed onto the securing member, the flange exerts a force that is axial to the cooling plate and the sampler, thereby forcing the sampler onto the cooling plate. A graphite seal (not shown) provided between the sampler and the cooling plate ensures an airtight seal between the sampler and the cooling plate. Panel 80 on which the sampling interface is mounted via screws 81 represents the front end of the mass spectrometer housing.

Figure 4:
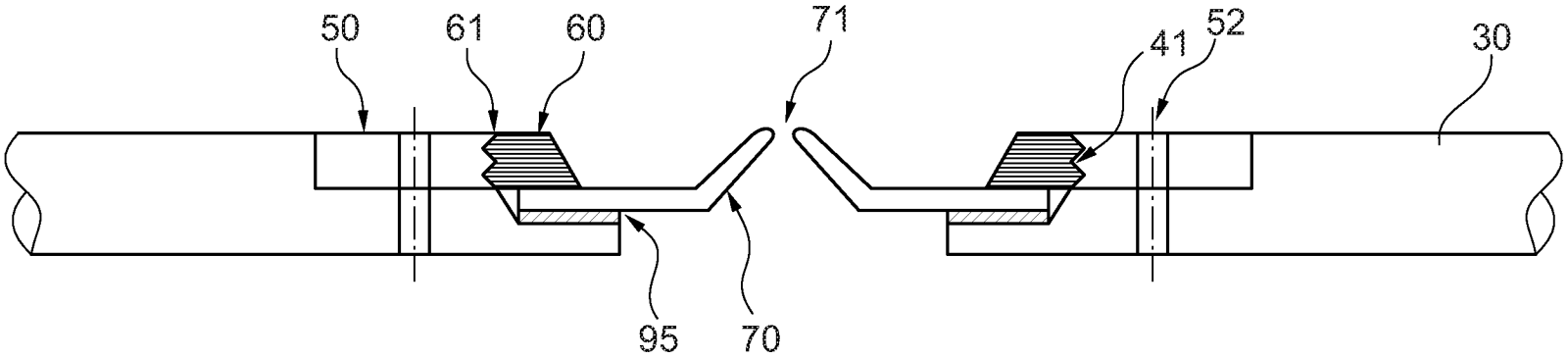
FIG. 4 shows a cross-sectional view of a cooling plate and sampler assembly in accordance with the invention.

The cross-sectional illustration of a cooling plate as provided in FIG. 4 shows the connection and sealing features of sampler 70 onto the cooling plate 30 via securing flange 60 and a securing member having a circular shape so as to be provided as securing ring 50. As can be seen in this view, the cooling plate is provided with stepwise recesses surrounding the entry opening in the plate, to accommodate the sampler 70, securing ring 50 and securing flange 60. Sampler 70 thus sits on the innermost of these stepwise recesses, a graphite sealing 95 being disposed on the innermost recess, where it meets an outer peripheral portion of the sampler 70, so as to provide a seal between the sampler 70 and the cooling plate 30. Securing ring 50 is attached to cooling plate 30 via screws (not shown) that screw into threaded holes 52 on the securing ring and matching threaded holes on the cooling plate. The holes 52 are shown to extend through the cooling plate. However, it will be appreciated that the holes may extend only partially into the cooling plate, being open towards the securing member 50 only. The securing ring is provided with a thread 61 on its inner peripheral edge that encircles the entry opening in the plate. Securing flange 60 contains a complementary thread 41 on its outer peripheral edge, such that the flange can be screwed onto the securing ring. As the securing flange 60 is screwed onto the securing ring, it exerts an axial force on the sampler 70, pressing and securing the sampler 70 onto the cooling plate 30, the sealing 95 providing an airtight seal between the sampler 70 and the cooling plate 30.

Figure 5:
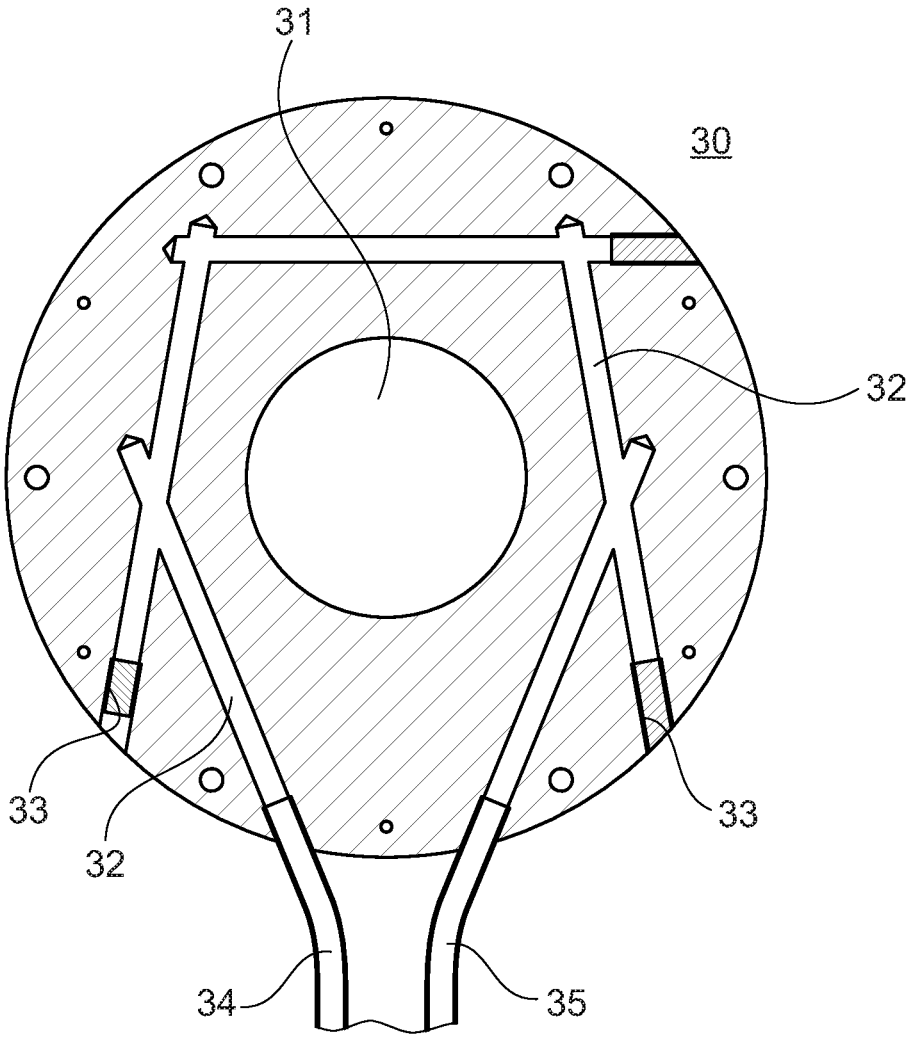
FIG. 5 shows an embodiment in which an internal fluid channel is provided within the cooling plate so that it can be cooled.

The cooling can be provided via internal channels that allow for circulation of a coolant within the plate. In FIG. 5, an exemplary embodiment illustrating such channels is shown. Thus, a cross-sectional view of the cooling plate is shown, wherein a series of interconnected channels 32 are provided. Inlet tube 34 and outlet tube 35 are connected to the channels 32, thereby allowing pumping of a coolant through the plate. In this embodiment, the channels 32 are formed by interconnected straight channels that can be drilled into the plate, and closed by plugs 33, with the exception of the portions of the channel 32 that is connected to the inlet and outlet tubes 34,35.

It will be appreciated that this embodiment only shows one possible way of providing coolant circulation within the plate. Thus, the cooling plate can be cooled by providing alternative shapes and dimensions of internal channels in the plate. The channels may therefore be straight or curved, or may contain a combination of curved and straight segments. The channels may further be machined into the cooling plate using any known means in the art. Thus, the channels may be formed by a series of interconnected straight channels, as illustrated by way of the example shown in FIG. 5. In the example of FIG. 5, the channels 32 are closed off at the peripheral edge of the cooling plate by plugs 33, the exception being the open ends of the resulting interconnected channels that provide an entry opening and an exit opening allowing the circulation of liquid through the channels. Alternatively, the channels may be provided as being integral to the plate, i.e. not extending to the outer peripheral edge of the plate, with the exception of an inlet (entry opening) and an outlet (exit opening) for delivering and releasing fluid. Preferably, the channels extend around the cooling plate in a symmetrical or near-symmetrical fashion, so as to provide uniform cooling of the cooling plate when in use.

As will be appreciated from the foregoing, some advantages of the present invention include:

1. A bronze cooling plate that is highly resistant to corrosion and other chemical degradation.
2. A bronze cooling plate that does not require a coating layer, thus eliminating effects due to flaking, blistering or other degradation of the coating.
3. More stable operation of ICP-MS instruments by employing bronze cooling plates.
4. Increased operating temperature of sampler cones that are mounted on bronze cooling plates, resulting in reduced matrix effects.
5. Less contamination effects from degradation of the cooling plate and reduced matrix effects due to increased operating temperature of the sampler cones.

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components.

It will be appreciated that variations to the foregoing embodiments of the invention can be made while still falling with the scope of the invention can be made while still falling within scope of the invention. Features disclosed in the specification, unless stated otherwise, can be replaced by alternative features serving the same, equivalent or similar purpose. Thus, unless stated otherwise, each feature disclosed represents one example of a generic series of equivalent or similar features.

Use of exemplary language, such as "for instance", "such as", "for example" and the like, is merely intended to better illustrate the invention and does not indicate a limitation on the scope of the invention unless so claimed. Any steps described in the specification may be performed in any order or simultaneously, unless the context clearly indicates otherwise.

All of the features and/or steps disclosed in the specification can be combined in any combination, except for combinations where at least some of the features and/or steps are mutually exclusive. In particular, preferred features of the invention are applicable to all aspects of the invention and may be used in any combination.

Example 1

The stability of a water-cooled cooling plate made from bronze over time was tested by allowing the cooling plate to experience prolonged exposure conditions of an ICP source.

The cooling plate (as illustrated in FIG. 2) was prepared from solid bronze (88% Cu, 12% Sn) and mounted on a sample interface, to provide the front face of the interface that faces the ICP source when in use. A sampler cone, made from solid Pt, was mounted on the plate, as illustrated in FIG. 3.

The interface, comprising the water-cooled bronze plate was subjected to a treatment of continuous exposure to plasma at a power of 1250 watts for 14 days, with a stream of isopropanol being injected into the plasma during this time.

At the end of the treatment period, the cooling plate and the sampler cone were inspected for deterioration by optical microscopy. No visual change in the orifice size of the sampler cone was observed, indicating that the cooling plate maintained its chemical integrity, at least to the extent that it did not lead to visible degeneration of the sampler cone.

The invention claimed is:

1. A plasma sampling interface for an inductively coupled plasma mass spectrometer (ICP-MS), the interface comprising:

a housing comprising an entry opening for introducing ions from plasma generated by an inductively coupled plasma source into an internal chamber of the housing and an exit opening for releasing ions from the internal chamber;

a sampler having a sampling aperture, the sampler being mounted on the housing, wherein the sampler, when in use, is disposed adjacent to plasma generated by the inductively coupled plasma source so as to sample ions from the plasma and release sampled ions through the entry opening into the internal chamber, wherein the entry opening is provided in a cooling plate that is integral to said housing, the sampler being mounted on the cooling plate so as to at least partially cover the entry opening, and wherein the cooling plate is formed from bronze, and wherein the cooling plate does not comprise a coating or deposit on its external surface.

2. The plasma sampling interface of claim 1, wherein the bronze consists of 70% to 95% copper by weight of the bronze, and wherein at least 80% by weight of the balance of the bronze consists of tin.

3. The plasma sampling interface of claim 1, wherein the bronze consists of 70% to 95% copper by weight of the bronze, and wherein the balance of the bronze consists of tin.

4. The plasma sampling interface of claim 1, wherein the bronze consists of 88% copper and 12% tin by weight of the bronze.

5. The plasma sampling interface of claim 1, wherein the sampler is mounted on the external surface of the cooling plate that, when in use, faces plasma from the inductively coupled plasma source.

6. The plasma sampling interface of claim 1, wherein the cooling plate surrounds at least an outer peripheral portion of the sampler.

7. The plasma sampling interface of claim 1, wherein the cooling plate is adapted for facing the plasma and disposed so as to provide at least a portion of an external surface of the housing that, during use, faces the plasma generated by the inductively coupled plasma source.

8. The plasma sampling interface of claim 1, wherein the sampler comprises a conical structure having an open tip to define the sampling aperture.

9. The plasma sampling interface of claim 8, wherein the sampler comprises a flange that extends radially away from the conical structure, wherein the flange is adapted to meet an outer surface of the cooling plate that surrounds the entry opening.

10. The plasma sampling interface of claim 9, wherein the flange is externally threaded and wherein the cooling plate comprises a threaded portion on its external surface, surrounding the entry opening, the threaded portion being adapted to receive the externally threaded flange so as to secure the flange to the cooling plate.

11. The plasma sampling interface of claim 1, wherein the sampler further comprises a securing flange, for securing the sampler to the cooling plate and configured to provide an airtight seal therebetween, the securing flange comprising an external thread that is adapted to meet a complimentary thread on the cooling plate, so as to secure the securing flange to the cooling plate and thereby exerting force onto the sampler so as to provide an airtight seal between the sampler and the cooling plate.

12. The plasma sampling interface of claim 11, further comprising a securing member adapted for mounting onto the external surface of the cooling plate and thereby encircling the entry opening of the cooling plate, the securing member further being threaded on an inner circular surface thereof, so as to provide the complimentary thread for securing the sampler to the cooling plate via the securing flange.

13. The plasma sampling interface of claim 1, wherein the bronze has a thermal conductivity that is in a range of 15-200 W/mK.

14. The plasma sampling interface of claim 1, wherein the housing further comprises a skimmer mounted on an inner surface thereof, opposite the sampler, the skimmer having an aperture for receiving ions from the plasma within the internal chamber, and release the sampled ions through the exit opening.

15. The plasma sampling interface of claim 1, further comprising a securing member for securing the sampler to the cooling plate.

16. The plasma sampling interface of claim 15, wherein the securing member comprises a circular structure that is adapted to meet an outer peripheral portion of the sampler, the securing member further comprising securing means for attaching the securing member to the cooling plate and thereby securing the sampler to the cooling plate.

17. The plasma sampling interface of claim 16, wherein the securing member is adapted to meet an outer circular portion of the sampler or the flange, so that when attached to the cooling plate, the securing member secures the sampler to the cooling plate.

18. The plasma sampling interface of claim 1, wherein the cooling plate comprises cooling means.

19. The plasma sampling interface of claim 1, wherein the cooling plate comprises at least one internal channel for allowing a stream of coolant to pass through and thereby cooling the cooling plate.

20. A cooling plate for receiving and cooling a plasma sampler in an Inductively Coupled Mass Spectrometer (ICP-MS), the cooling plate comprising at least one internal channel for transmission of a coolant through the cooling plate, an opening that extends axially through the cooling plate and a sampler seating portion that surrounds said opening, for receiving and securing a sampler to the cooling plate, the cooling plate being characterized in that the cooling plate is comprised of bronze, and wherein the cooling plate does not comprise a coating or deposit on its external surface.

21. The cooling plate of claim 20, wherein the bronze consists of 70% to 95% copper by weight of the bronze, and wherein at least 80% by weight of the balance of the bronze consists of tin.

22. The cooling plate of claim 20, wherein the bronze consists of 70% to 95% copper by weight of the bronze, and wherein the balance of the bronze consists of tin.

23. The cooling plate of claim 20, wherein the bronze consists of 88% copper and 12% tin by weight of the bronze.

24. The cooling plate of claim 20, wherein the sampler seating portion is adapted so that the sampler can be mounted on the external surface of the cooling plate so as to form a seal between the sampler and the sampler seating portion, so that plasma ions transmitted by the sampler can pass through the opening in the cooling plate.

25. The cooling plate of claim 24, wherein the cooling plate is adapted to receive a securing member configured to secure the sampler to the cooling plate.

26. The cooling plate of claim 25, wherein the securing member comprises a circular structure that is adapted to meet an outer peripheral portion of the sampler and thereby securing the sampler to the cooling plate.

27. The cooling plate of claim 20, wherein the cooling plate is adapted so that, when in use, the cooling plate provides at least a portion of an external surface of a plasma interface housing that faces plasma generated by an inductively coupled plasma source.

28. A method of operating a mass spectrometer sampling interface, the method comprising:

generating plasma by means inductively coupled plasma (ICP) source; and sampling the plasma by a sampler that is disposed adjacent to the plasma, wherein the sampler is mounted on an external surface of a plate that is integral to a housing of the mass spectrometer sampling interface, wherein the plate is adapted to allow sampled ions to pass through an opening in the plate and into a chamber within the mass spectrometer sampling interface, and wherein the plate is formed from bronze, and wherein the plate does not comprise a coating or deposit on the external surface.

29. The method of claim 28, wherein the sampling interface is vacuum pumped.

30. The method of claim 28, wherein the bronze consists of 70% to 95% copper by weight of the bronze, and wherein at least 80% by weight of the balance of the bronze consists of tin.

31. The method of claim 28, wherein the bronze consists of 70% to 95% copper by weight of the bronze, and wherein the balance of the bronze consists of tin.

32. The method of claim 28, wherein the bronze consists of 88% copper and 12% tin by weight of the bronze.

33. The method of claim 28, wherein the sampler is mounted on a seating portion on the external surface of the plate, surrounding the opening that extends through the plate, wherein the seating portion is adapted to receive the sampler so as to provide an airtight connection therebetween.

* * * * *